US009153907B2

(12) United States Patent
Yu

(10) Patent No.: US 9,153,907 B2
(45) Date of Patent: Oct. 6, 2015

(54) CONNECTOR

(75) Inventor: Gang Yu, Guandong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 140 days.

(21) Appl. No.: 13/642,546

(22) PCT Filed: Sep. 5, 2012

(86) PCT No.: PCT/CN2012/081026

§ 371 (c)(1), (2), (4) Date: Oct. 21, 2012

(87) PCT Pub. No.: WO2014/032319

PCT Pub. Date: Mar. 6, 2014

(65) Prior Publication Data

US 2014/0065868 A1 Mar. 6, 2014

(30) Foreign Application Priority Data

Aug. 31, 2012 (CN) ..... 2012 1 0317819

(51) Int. Cl.
*H01R 13/625* (2006.01)
*H01R 13/627* (2006.01)

(52) U.S. Cl.
CPC ..... *H01R 13/6278* (2013.01)

(58) Field of Classification Search
CPC ..... H01R 13/6278; H01R 13/627; H01R 13/506; H01R 13/4223
USPC ..... 439/345, 353, 357
See application file for complete search history.

(56) References Cited

U.S. PATENT DOCUMENTS

| | | | | |
|---|---|---|---|---|
| 4,900,261 | A * | 2/1990 | Gentry et al. | 439/353 |
| 5,549,375 | A * | 8/1996 | Pagliaccio | 312/319.1 |
| 5,551,883 | A * | 9/1996 | Davis | 439/65 |
| 6,238,236 | B1 * | 5/2001 | Craft, Jr. | 439/425 |
| 7,364,475 | B2 * | 4/2008 | Curtis et al. | 439/700 |
| 2012/0289076 | A1 * | 11/2012 | Wolff et al. | 439/345 |

* cited by examiner

*Primary Examiner* — Xuong Chung Trans
(74) *Attorney, Agent, or Firm* — Andrew C. Cheng

(57) ABSTRACT

The present invention discloses a connector, which includes a male housing and a female housing. The male housing is formed of three side walls surrounding a circumference of a bottom wall and the female housing is formed of three side walls surrounding a circumference of a bottom wall. The male housing and the female housing are mateable with each other through mutual insertion. Practicing the connector of the present invention may reduce the wall thickness of the connector, making the connector thinner so as to enable use in a backlight module arrangement of relatively small space and provide module designing with more flexibility.

15 Claims, 2 Drawing Sheets

Figure 2

CONNECTOR

CROSS REFERENCE TO RELATED APPLICATIONS

This application claims the priority of Chinese Patent Application No. 201210317819.1 filed on Aug. 31, 2012, the disclosure of which is incorporated herein by reference in its entirety.

BACKGROUND OF THE INVENTION

1. Field of the Invention

The present invention relates to the field of liquid crystal panel manufacturing, and in particular to a connector.

2. The Related Arts

As shown in FIG. 3, a schematic view of a conventional connector is shown. The conventional connector comprises a male housing 8 and a female housing 9. The male housing 8 and the female housing 9 are each formed by being surrounded by four side walls that are connected end to end. The female housing 9 is insertable into a chamber defined in the male housing 8 to effect connection between mating ports set up in the chambers defined in the housing.

Connectors of such structures, once inserted and connected, show four wall thicknesses in the height direction, making it hard to use in an arrangement of backlight module that provides a relatively small space.

SUMMARY OF THE INVENTION

The technical issue to be addressed by the present invention is to provide a connector, which reduces the wall thickness of the connector, making the connector light-weighted and compact so as to be useful in a backlight module arrangement of relatively small space thereby provide the design of backlight module with more flexibility.

To address the above technical issue, an embodiment of the present invention provides a connector, which comprises a male housing and a female housing. The male housing is formed of three side walls surrounding a circumference of a bottom wall and the female housing is formed of three side walls surrounding a circumference of a bottom wall.

And, the male housing and female housing are mateable with each other through mutual insertion.

Preferably, the female housing has two opposite side walls on which pawls are formed and the male housing has two opposite side walls in which retention slots are formed at locations corresponding to the pawls.

Preferably, the male housing mates the female housing through retaining engagement between the pawls and the retention slots.

Preferably, when the male housing mates the female housing through mutual insertion, an end face of a side opening of the female housing is positioned against a first side wall of the male housing. The first side wall is arranged to oppose the side opening of the male housing.

Preferably, retention slots are formed in a side wall that is adjacent to the first side wall.

Preferably, the female housing has a second side wall, which opposes a side opening of the female housing.

And, when the male housing and the female housing mate each other through mutual insertion, an end face of a side opening of the male housing is substantially flush with the second side wall.

Preferably, pawls are formed on a side wall that is adjacent to the second side wall.

With the connector provided by the present invention, since the male housing and the female housing are each formed of three side walls mounted to and surrounding a circumference of a bottom wall, when the male housing and the female housing mate each other through mutual insertion, there are only two walls existing in the height direction of the connector thereby reducing the wall thickness of the connector, making the connector thinner so as to enable use in a backlight module arrangement of relatively small space and provide module designing with more flexibility.

DETAILED DESCRIPTION OF THE PREFERRED EMBODIMENTS

A description will be given to preferred embodiments of the present invention, reference being had to the attached drawings.

An embodiment of the present invention provides a connector, which comprises a male housing 1 and a female housing 2, wherein the male housing 1 comprises three side walls mounted to a bottom wall and the female housing 2 comprises three side walls mounted to a bottom wall.

The male housing 1 and the female housing 2 mate each other and are insertable to each other.

Both the male housing 1 and the female housing 2 are formed by being surrounded by three side walls and, compared to the conventional structure of cable connectors, each housing has one side wall less so that the thickness of the male housing 1 and the female housing 2 is reduced and thinning the connector can be realized. The structure and operation of the connector according to the present invention will be described in more details.

Figure 1:
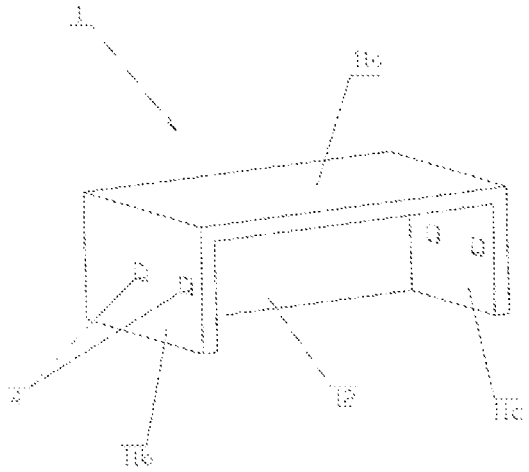
FIG. 1 is a schematic view showing a male housing of a connector according to an embodiment of the present invention.

Referring to FIG. 1, the male housing 1 comprises threes side walls surrounding a bottom wall to define a hollow insertion chamber structure. The three side walls are sequentially a first side wall 11*a* and side walls 11*b* and 11*c* perpendicularly connected to two ends of the first side wall 11*a*, all having the same height. The two side walls 11*b* and 11*c* are opposite to each other and are parallel to each other.

The side walls 11*a*, 11*b*, and 11*c* are mounted perpendicular to and surrounding the bottom wall 12 to form the male housing 1.

The male housing 1 has a top opening and a side opening, wherein the one of the openings that opposes the bottom wall 12 is the top opening and the one opposing the first side wall 11*a* is the side opening. The side opening has an end face that is parallel to the plane on which the first side wall 11*a* is located.

Figure 2:
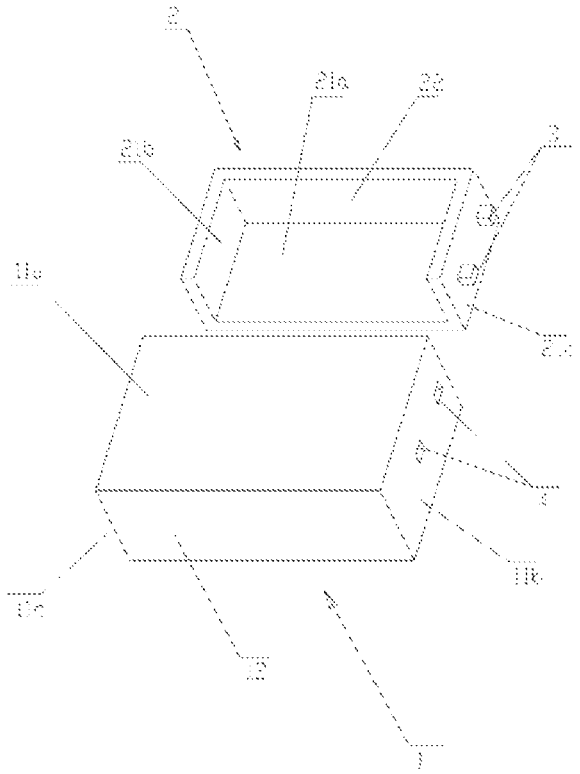
FIG. 2 is a schematic view illustrating the assembly of the connector according to the embodiment of the present invention.
Figure 3:
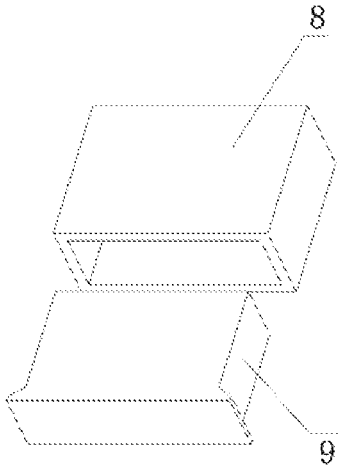
FIG. 3 is a schematic view showing a conventional connector.

As shown in FIG. 2, the female housing 2 is also formed of three side walls mounted to and surrounding a circumference of a bottom wall to define a hollow insertion chamber structure. The female housing 2 has a volume slightly smaller than the volume of the male housing 1 and is thus insertable into the chamber of the male housing 1. The three side walls of the female housing 2 are sequentially a second side wall 21*a* and side walls 21*b* and 21*c* perpendicularly connected to two ends of the second side wall 21*a*, all having the same height. The two side walls 21*b* and 21*c* are opposite to each other and are parallel to each other.

The side walls 21*a*, 21*b*, and 21*c* are mounted perpendicular to and surrounding the bottom wall 22 to form the female housing 2.

The female housing 2 also has a top opening and a side opening, wherein the one of the openings that opposes the bottom wall 22 is the top opening and the one opposing the second side wall 21*a* is the side opening. The side opening has an end face that is parallel to the plane on which the second side wall 21*a* is located.

The male housing 1 and the female housing 2 are mateable with and insertable into each other, meaning the female housing 2 is completely receivable, through insertion, in the chamber of the male housing 1 in order to achieve connection between corresponding ports provided in the chambers.

The two housing may achieve reliable connection through the following arrangement. The two opposite side walls 21*b* and 21*c* of the female housing 2 are each provided with a plurality of pawls 3 (two being shown in the drawings), while the two opposite side walls 11*b* and 11*c* of the male housing 1 are each provided with retention slots 4 (two being shown in the drawings) in locations corresponding to the pawls 3. When the male housing 1 and the female housing 2 mate each other through mutual insertion, the pawls 3 are completely received and retained in the retention slots 4 to fix the female housing 2 in the male housing 1.

In practicing the above described process for insertion, the side openings of the male housing 1 and the female housing 2 are arranged opposite to each other so that after the completion of the assembly, where the pawls 3 are retained in the retention slots 4, the end face of the side opening of the female housing 2 is positioned against the first side wall 11*a* of the male housing 1 and the end face of the top opening of the female housing 2 is positioned against the bottom wall 12 of the male housing 1. The end face of the side opening of the male housing 1 is substantially flush with the second side wall 21*a* and the end face of the top opening of the male housing 1 is substantially flush with the bottom wall 22 of the female housing 2. In this way, the connector after being completely assembled exhibits only two wall thickness in the height direction, namely the first side wall 11*a* and the second side wall 21*a* thereby achieving the object of making the connector even thinner and enabling use in a backlight module arrangement of relatively small space.

In other embodiments of connector according to the present invention, it is feasible to form retention slots in only one of the side walls adjacent to the first side wall and to provide pawls to only one of the side walls adjacent to the second side wall; or alternatively, the pawls and the retention slots may be switched with each other. Other commonly used connection, such as interference fitting, may be used to realize reliable connection between the two housings.

By practicing the connector according to the present invention, since the male housing and the female housing are each formed of three side walls mounted to and surrounding a circumference of a bottom wall, when the male housing and the female housing mate each other through mutual insertion, there are only two walls existing in the height direction of the connector thereby reducing the wall thickness of the connector, making the connector thinner so as to enable use in a backlight module arrangement of relatively small space and provide module designing with more flexibility.

What is claimed is:

1. A connector, comprising: a male housing and a female housing, wherein the male housing is formed of three side walls surrounding a circumference of a bottom wall and having a side opening opposing a first side wall of the three side walls of the male housing and a top opening opposing the bottom wall; and the female housing is formed of three side walls surrounding a circumference of a bottom wall and having a side opening opposing a second side wall of the three side walls of the female housing and a top opening opposing the top wall; and the male housing and female housing are mateable with each other through mutual insertion so that the female housing is completely received in the male housing, wherein the side opening of the male housing is closed by the second side wall of the female housing and the side opening of the female housing is closed by the first side wall of the male housing whereby the connector contains only the first side wall of the male housing and the second side wall of the female housing in a predetermined direction; and wherein the top opening of the male housing is closed by the bottom wall of the female housing and the top opening of the female housing is closed by the bottom wall of the male housing whereby the connector contains only the bottom wall of the male housing and the bottom wall of the female housing in a normal direction of the bottom walls of the male and female housings.

2. The connector as claimed in claim 1, wherein the female housing has two opposite side walls on which pawls are formed and the male housing has two opposite side walls in which retention slots are formed at locations corresponding to the pawls.

3. The connector as claimed in claim 2, wherein the male housing mates the female housing through retaining engagement between the pawls and the retention slots.

4. The connector as claimed in claim 1, wherein the male housing mates the female housing through mutual insertion, an end face of the side opening of the female housing is positioned against the first side wall of the male housing.

5. The connector as claimed in claim 4, wherein retention slots are formed in a side wall that is adjacent to the first side wall.

6. The connector as claimed in claim 1, wherein when the male housing and the female housing mate each other through mutual insertion, an end face of the side opening of the male housing is substantially flush with the second side wall.

7. The connector as claimed in claim 6, wherein pawls are formed on a side wall that is adjacent to the second side wall.

8. The connector as claimed in claim 6, wherein the pawls are formed on a side wall that is adjacent to the second side wall.

9. A connector, comprising: a male housing and a female housing, wherein the male housing is formed of three side walls surrounding a circumference of a bottom wall and having a side opening opposing a first side wall of the three side walls of the male housing and a top opening opposing the bottom wall; and the female housing is formed of three side walls surrounding a circumference of a bottom wall and having a side opening opposing a second side wall of the three side walls of the female housing and a top opening opposing the top wall;

the three side walls of the female housing include two opposite side walls on which pawls are formed and the three side walls of the male housing include two opposite side walls in which retention slots are formed at locations corresponding to the pawls; and when the male housing mates the female housing through retaining engagement between the pawls and the retention slots, the female housing is completely received in the male housing and an end face of the side opening of the female housing is positioned against the first side wall of the male housing so that the side opening of the male housing is closed by the second side wall of the female housing and the side opening of the female housing is closed by the first side wall of the male housing whereby the connector contains only the first side wall of the male housing and the second side wall of the female housing in a predetermined direction; and the top opening of the male housing is closed by the bottom wall of the female housing and the top opening of the female housing is closed by the bottom wall of the male housing whereby the connector contains only the bottom wall of the male housing and the bottom wall of the female housing in a normal direction of the bottom walls of the male and female housings.

10. The connector as claimed in claim 9, wherein the retention slots are formed in a side wall that is adjacent to the first side wall.

11. The connector as claimed in claim 9, wherein when the male housing and the female housing mate each other through mutual insertion, an end face of the side opening of the male housing is substantially flush with the second side wall.

12. A connector, comprising: a male housing and a female housing, wherein the male housing is formed of three side walls surrounding a circumference of a bottom wall and having a side opening opposing a first side wall of the three side walls of the male housing and a top opening opposing the bottom wall; and the female housing is formed of three side walls surrounding a circumference of a bottom wall and having a side opening opposing a second side wall of the three side walls of the female housing and a top opening opposing the top wall;

the three side walls of the female housing include two opposite side walls on which pawls are formed and the three side walls of the male housing include two opposite side walls in which retention slots are formed at locations corresponding to the pawls, the female housing having a second side wall, which opposes a side opening of the female housing; and when the male housing mates the female housing through retaining engagement between the pawls and the retention slots, the female housing is completely received in the male housing and an end face of the side opening of the male housing is substantially flush with the second side wall so that the side opening of the male housing is closed by the second side wall of the female housing and the side opening of the female housing is closed by the first side wall of the male housing whereby the connector contains only the first side wall of the male housing and the second side wall of the female housing in a predetermined direction; and the top opening of the male housing is closed by the bottom wall of the female housing and the top opening of the female housing is closed by the bottom wall of the male housing whereby the connector contains only the bottom wall of the male housing and the bottom wall of the female housing in a normal direction of the bottom walls of the male and female housings.

13. The connector as claimed in claim 12, wherein the pawls are formed on a side wall that is adjacent to the second side wall.

14. The connector as claimed in claim 12, wherein when the male housing and the female housing mate each other through mutual insertion, an end face of the side opening of the female housing is positioned against the first side wall of the male housing.

15. The connector as claimed in claim 14, wherein the retention slots are formed in a side wall that is adjacent to the first side wall.

* * * * *